US006147463A

United States Patent [19]

Luger et al.

[11] Patent Number: 6,147,463

[45] Date of Patent: Nov. 14, 2000

[54] ELECTRONIC BALLAST FOR THE OPERATION OF AT LEAST ONE GAS DISCHARGE LAMP

[75] Inventors: Siegfried Luger; Alfred Tröstl, both of Dornbirn, Austria

[73] Assignee: Tridonic Bauelemente GmbH, Dornbirn, Austria

[21] Appl. No.: 09/387,846

[22] Filed: Sep. 1, 1999

Related U.S. Application Data

[63] Continuation of application No. PCT/EP98/01159, Mar. 2, 1998.

[30] Foreign Application Priority Data

Mar. 4, 1997 [DE] Germany ..... 197 08 791

[51] Int. Cl.[7] ..... G05F 1/00

[52] U.S. Cl. ..... 315/307; 315/209 R; 315/308; 315/DIG. 4; 315/DIG. 5; 315/DIG. 7

[58] Field of Search ..... 315/224, 227 R, 315/209 R, 291, 307, 308, DIG. 4, DIG. 5, DIG. 7

[56] References Cited

U.S. PATENT DOCUMENTS

| | | | |
|---|---|---|---|
| 4,086,804 | 5/1978 | Ruby | 73/4 |
| 4,396,872 | 8/1983 | Nutter | 315/DIG. 4 |
| 4,717,863 | 1/1988 | Zeiler | 315/307 |
| 5,039,921 | 8/1991 | Kakitani | 315/DIG. 5 |
| 5,107,184 | 4/1992 | Hu et al. | 315/291 |
| 5,250,799 | 10/1993 | Werner | 250/214 |
| 5,471,119 | 11/1995 | Ranganath et al. | 315/307 |
| 5,677,602 | 10/1997 | Paul et al. | 315/224 |
| 5,680,015 | 10/1997 | Bernitz et al. | 315/291 |
| 5,739,644 | 4/1998 | Bernitz et al. | 315/209 R |
| 5,828,178 | 10/1998 | York et al. | 315/308 |
| 5,859,505 | 1/1999 | Bergman et al. | 315/291 |
| 5,925,990 | 7/1999 | Crouse et al. | 315/308 |
| 5,936,357 | 8/1999 | Crouse et al. | 315/308 |
| 5,942,860 | 8/1999 | Huynh | 315/DIG. 7 |
| 5,952,794 | 9/1999 | Bergman et al. | 315/307 |
| 5,973,455 | 10/1999 | Mirskiy et al. | 315/DIG. 4 |
| 6,031,340 | 2/2000 | Brosius | 315/227 R |

FOREIGN PATENT DOCUMENTS

| | | |
|---|---|---|
| 0291223A1 | 11/1988 | European Pat. Off. . |
| 0338109A1 | 10/1989 | European Pat. Off. . |
| 0413991A1 | 2/1991 | European Pat. Off. . |
| 0449667A2 | 10/1991 | European Pat. Off. . |
| 0560255A1 | 9/1993 | European Pat. Off. . |
| 0582287A2 | 2/1994 | European Pat. Off. . |
| 0708579A1 | 4/1996 | European Pat. Off. . |
| 4039161A1 | 6/1992 | Germany . |
| 4228641A1 | 3/1994 | Germany . |
| 296 01 289 U1 | 4/1996 | Germany . |
| 19530485A1 | 2/1997 | Germany . |

OTHER PUBLICATIONS

García, Juan Garzón, "Entwicklungeines Universellen Rechnergefuhrten Systems Zur Ansteuerung Eines Elektronischen Vorschaltgerates—Evg" Jul. 1995, Thesis—University of Karlsruhe.

*Primary Examiner*—Don Wong
*Assistant Examiner*—Thuy Vinh Tran
*Attorney, Agent, or Firm*—Fitzpatrick, Cella, Harper & Scinto

[57] ABSTRACT

Control device (3) for the operation of a load, in particular at least one gas discharge lamp (10, 15). The control device (3) is divided into a first purely software controlled control unit (3*a*) a second control unit (3*b*) realized purely in hardware. The two control units (3*a*, 3*b*) are connected with one another via a bidirectional connection line, the second control unit receiving exclusively internal operating state information ($I_{intern}$) and the first control unit (3*a*) receiving external control information ($I_{extern}$) By means of the division of the control device into a purely software controlled control unit (3*a*) and a control unit constructed purely of hardware (3*b*) the control device (3) in accordance with the invention has both a speed sufficient for rapid control procedures and also a sufficient flexibility with regard to alterations. Advantageously, the control device (3) in accordance with the invention is employed in an electronic ballast for the operation of gas discharge lamps (10, 15).

18 Claims, 2 Drawing Sheets

ELECTRONIC BALLAST FOR THE OPERATION OF AT LEAST ONE GAS DISCHARGE LAMP

CROSS REFERENCE TO RELATED APPLICATIONS

This is a continuation of co-pending International Application No. PCT/EP98/01159, filed Mar. 2, 1998.

BACKGROUND OF THE INVENTION

1. Field of the Invention

The present invention relates to an electronic ballast for the operation of at least one gas discharge lamp.

2. Description of the Related Art

By means of the alternating control of the switches of the inverter 2 there is generated on the output side of the inverter 2 a clocked, i.e. "chopped", high frequency a.c. voltage which serves as operating voltage for the gas discharge lamp. For the ignition of the gas discharge lamp 10, the output frequency of the inverter 2 is displaced into the vicinity of the resonance frequency of the series resonance circuit having the coil 4 and the capacitor 5, so that a voltage overshoot appears at the capacitor 5 which then leads to the ignition of the gas discharge lamp. In order to extend the lifetime of the gas discharge lamp 10 it is desirable to pre-heat the two lamp coils of the gas discharge lamp 10 before the ignition. For this purpose, there is provided a heating transformer having a primary winding 7A and secondary windings 7B and 7C, whereby the primary winding 7A is connected with the series resonance circuit whilst the secondary windings 7B and 7C are connected each in parallel to one of the lamp coils. By means of the connection of the secondary windings 7B and 7C to the lamp coils of the gas discharge lamp 10 it is possible to supply the lamp coils with energy also in ignited operation of the gas discharge lamp 10.

The central control unit shown in FIG. 2 serves for the generation of control signals for the operation of the gas discharge lamp 10, whereby the control signals of the central control unit 3 are generated in dependence upon internal and external operating state and control information. Thus, for example, the central control unit 3 monitors the heating current $i_H$ flowing via the primary winding 7A of the heating transformer in that the voltage dropped across a resistance 8 is delivered to the central control unit 3. Further, the central control unit 3 receives a parameter corresponding to the lamp current $i_L$ flowing through the gas discharge lamp path of the gas discharge lamp 10, in that a voltage dropped across a resistance 9 is delivered to the central control unit 3. As will be described in more detail below, it is also desirable to deliver to the central control unit 3 the impedance angle of the load circuit connected to the inverter 2. For this purpose, a phase comparator 12 determines the phase angle between the lamp voltage $U_L$ and the lamp current $i_L$. Further, the lamp voltage $U_L$ is directly applied to the central control unit 3 itself as operating state information. As shown in FIG. 2, the central control unit 3 also monitors the mains voltage $U_N$ and the rectified intermediate circuit voltage $U_G$ delivered from the rectifier 1.

Along with these items of internal operating state information, the central control unit 3 however also evaluates external control information $I_{extern}$ which is delivered for example as desired-value information (e.g. for the dimming of the gas discharge lamp 10) or as illumination actual-value information of the central control unit 3, detected by a light sensor, via a (serial) interface.

It is known to provide the central control unit 3 in the form of a microcontroller, i.e. microprocessor, which centrally receives and evaluates all internal and external information and issues corresponding control signals for the operation of the gas discharge lamp 10. These control signals may for example switch the inverter 2 on or off or vary the frequency f or the duty ratio d of the a.c. voltage delivered by the inverter 2. Such a microcontroller, however, carries out its control functions, i.e. the generation of control signals, exclusively on the basis of a corresponding software programming, so that a central control unit 3 formed solely by means of a microcontroller is not suitable for rapid control processes, since before generation of a corresponding control signal the microcontroller must always first carry out the corresponding software program.

It is further known to realise the central control unit 3 exclusively by combining predetermined standard circuits, for example in the form of an integrated circuit. In this case, the central control unit 3 is provided exclusively as hardware. Such a central control unit 3 realized purely in hardware terms has however the disadvantage that the control circuit can be adapted only with difficulty to, for example, changes relating to the control or operating state information to be detected. That is, with a pure hardware realisation of the central control unit 3, flexibility is greatly restricted.

If the central control unit is provided as a software controlled microcontroller, the central control unit can be adapted by simple manner and means to circuit changes etc., i.e. flexibility is high, but on the other hand, as has already been described above, the central control unit is in this case not suitable for rapid procedures.

From U.S. Pat. No. 5,107,184 there is known a control circuit in accordance with the preamble of claim 1, which is employed in an electronic ballast for the operation of gas discharge lamps. Thereby, with the aid of an integrated circuit, a plurality of items of internal operating state information.

If the central control unit is provided as a software controlled microcontroller, the central control unit can be adapted by simple manner and means to circuit changes etc., i.e. flexibility is high, but on the other hand, as has already been described above, the central control unit is in this case not suitable for rapid procedures generates operational information for the second control unit. Primarily, however, the first control unit functions as a monitoring device or communications device. The second control unit is clearly controlled in terms of hardware. Implicitly, it appears that the known ballast must further contain memory means for storing operational information.

In accordance with EP-A-582 287 there is known a phase angle or phase segment dimmer having a first control unit controlled purely in terms of software and a second control unit controlled purely in terms of hardware. The first control unit, controlled in terms of software, receives external control information and generates operational information for the second control unit. Along with this, however, the control unit controlled purely in terms of software also deals with monitoring functions. The second control unit controlled in terms of hardware processes the operational state information. The known dimmer also has memory means for storing operational information.

In accordance with DE-U-29 610 289 there is known an electronic ballast having a first control unit and a second control unit. The first control units include a CPU, so it can be assumed that this first unit is controlled in terms of software. It receives external control information and generates operational information for the second control unit. Primarily, however, the first control unit functions as a monitoring device or communications device. The second control unit is clearly controlled in terms of hardware. Implicitly, it appears that the known ballast must further contain memory means for storing operational information.

In accordance with EP-A-582 287 there is known a phase angle or phase segment dimmer having a first control unit controlled purely in terms of software and a second control unit controlled purely in terms of hardware. The first control unit, controlled in terms of software, receives external control information and generates operational information for the second control unit. Along with this, however, the control unit controlled purely in terms of software also deals with monitoring functions. The second control unit controlled in terms of hardware processes the operational state information. The known dimmer also has memory means for storing operational information.

In accordance with U.S. Pat. No. 4,086,804 there is known a pneumatic pressure supply system which includes an external digitally functioning control loop and an internal analog functioning control loop.

SUMMARY OF THE INVENTION

In accordance with U.S. Pat. No. 4,086,804 there is known a pneumatic pressure supply system which includes an external digitally functioning control loop and an internal analog functioning control loop.

The object of the present invention is in general to provide an electronic ballast with a control device which on the one hand is suitable for rapid control procedures and on the other hand has sufficient flexibility for circuitry engineering alterations etc.

In accordance with the invention, this object is achieved by means of an electronic ballast according to claim 1.

The control device, of the electronic ballast in accordance with the present invention consists of a series connection of two control units, whereby one control unit is realized purely in terms of software and the other control unit purely in terms of hardware. That is, the control unit controlled purely in terms of software can be present for example in the form of a microcontroller, e.g. a microprocessor, while the control unit realized purely in terms of hardware may be present in the form of an application specific integrated circuit (ASIC). The control unit controlled purely in software terms serves to deal with slow control procedures whilst the purely hardware control unit serves to deal with the rapid control procedures. By means of this division of the control device into a control unit controlled in software terms and a control unit, connected therewith, realized in purely hardware terms, on the one hand a sufficiently high flexibility is ensured by means of the employment of the control unit controlled in software terms and on the other hand there is ensured a sufficiently great speed for rapid control procedures by means of the employment of the control unit realized in pure hardware terms. The employment of these two control units thus represents an optimal compromise solution with regard to flexibility, operational speed, and manufacturing cost of the overall circuit.

The two control units are connected via an interface with the aid of a bi-directional connection line for the exchange of information between the control units. The control unit controlled in terms of software initially receives exclusively external control information, i.e. control information delivered from the outside, which for example may be delivered from a central station of the control device via a bus line or a serial interface. This external control information may be desired-value settings for particular control parameters, or external state information. In the case of the control of a gas discharge lamp, the desired-value information may relate for example to dimming information and the external state information may relate for example to brightness information in a room in which the gas discharge lamp is arranged.

The second control unit, realized in purely hardware terms, monitors exclusively internal operating state information, which relates to the load to be controlled. This operating state information includes also fault information relating to fault conditions appearing, if applicable, upon control of the load. In the case of control of a gas discharge lamp, this operating state information may for example be the lamp voltage, the lamp current or the heating current. The fault condition information may be for example the presence of the so-called rectifier effect, an excessive lamp voltage or an excessive lamp current with regard to the gas discharge lamp to be controlled.

These items of operating state information are, in accordance with the invention, called up by the first control unit, realised purely in software terms, via the bi-directional connection line, so that the first control unit on the basis of the now available external control information and internal operating state information can generate the actual operating control information for the control of the corresponding load, for example the gas second control unit, so that at any time this information can be called up again from the memory or new information can be again placed in the memory.

A further advantage of the present invention is to be seen in that the control unit controlled in software terms makes possible at least within certain limits that an electronic ballast or lamp operating apparatus can be employed for different lamp types or wattages, since with the aid of the control unit controlled in software terms lamp-specific control information can be predetermined. The provision of a write-read memory for the intermediate storage of the operational control information and/or the internal operating state information is important for this, since upon each switching on of the electronic ballast an initialisation procedure of the second control unit controlled in terms of hardware is necessary. So that the operation of different load types, i.e. in particular different lamp types, is possible there must be loaded into the registers contained in the control unit controlled in hardware terms the operational control information of the control unit controlled in software terms dependent in each case upon the operated load type (lamp type), which corresponds to the above-mentioned initialisation procedure and is thus supported by means of the above explained write-read memory.

Further, the write-read memory proposed in accordance with the invention, through the intermediate storage of the internal operating state information, also allows a subsequent external read out and, if appropriate, printout of the stored operating state information, in order for example to obtain information on defective lamps, operating times or the cost effectiveness of the controlled illumination equipment.

Finally, there is advantageously also provided in accordance with the invention that the information available to the control unit controlled in software terms can also be read out externally via a corresponding interface of this control unit, so that for example the internal operating state information transferred from the control unit realised purely in hardware terms to the control unit controlled in software terms can be externally read out.

BRIEF DESCRIPTION OF THE DRAWINGS

The invention will be described in more detail with reference to a preferred exemplary embodiment and with reference to the drawings in which:

FIG. 2 shows a preferred exemplary embodiment of an electronic ballast in accordance with the invention for the operation of two gas discharge lamps, whereby in the electronic ballast shown in FIG. 1 the control circuit in accordance with the invention finds employment.

DETAILED DESCRIPTION OF THE PREFERRED EMBODIMENTS

Figure 2:
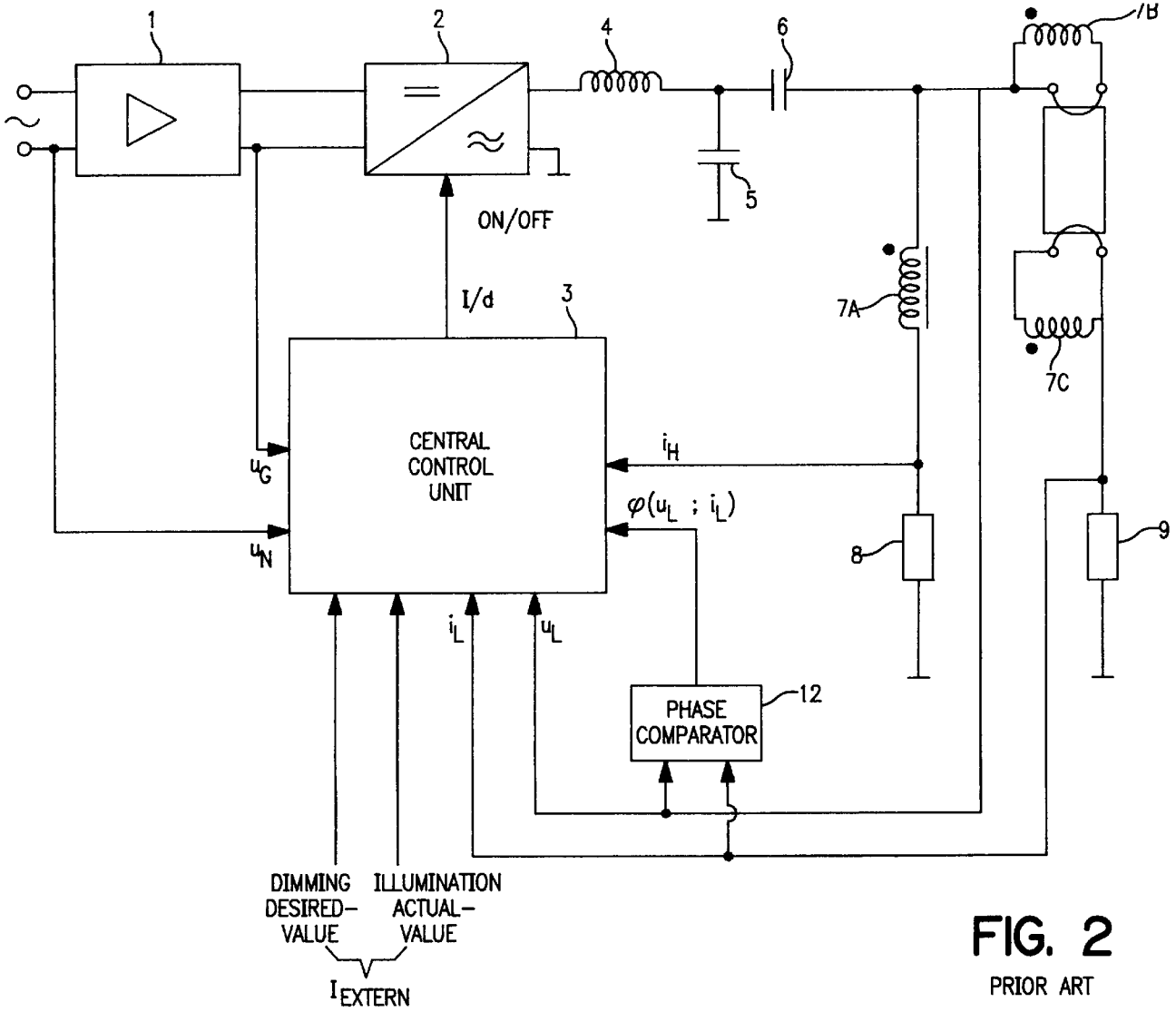
FIG. 2 PRIOR ART
FIG. 2 shows the employment of a known control circuit in a known electronic ballast for the operation of a gas discharge lamp.

As already explained with reference to FIG. 2, the electronic ballast includes a rectifier 1, an inverter 2, a series resonance circuit connected to the inverter 2, having a coil 4 and a capacitor 5, and a coupling capacitor 6 via which two gas discharge lamps 10 and 15 are connected to the series resonance circuit. There is present for each of these two gas discharge lamps a heating transformer having a primary winding 7A or 11A and secondary windings 7B, 7C or 11B, 11C connected parallel to the lamp coils. The part circuits each including one gas discharge lamp and the corresponding heating transformer are each identically connected to the series resonance circuit.

A central control device 8 monitors a plurality of different operating state parameters of the electronic ballast and further receives external control information, such as for example desired-value inputs or actual values. The control device 3 regulates or controls the operational parameters important for the operation of the gas discharge lamps 10 and 15, in dependence upon this information, such as for example the frequency f or the duty ratio d of the high frequency clocked a.c. voltage delivered by the inverter 2, the ignition voltage, the pre-heating voltage, the pre-heating time or the ignition repetition time of the operated gas discharge lamps 10 and 15.

Between the rectifier 1 and the inverter 2 there may be arranged a (not shown) controllable electronic harmonics filter which smooths the rectified voltage of the rectifier 1 and delivers it to the inverter 2. The characteristics of the electronic harmonics filter may thereby be set by means of corresponding control signals of the control circuit 3.

As internal operating state information $I_{intern}$ there are detected for example the lamp currents $i_{L1}$ and $i_{L2}$ flowing through the gas discharge paths of the two gas discharge lamps 10 and 15. For this purpose a resistance 9 or 14 is connected in series with the gas discharge lamp 10 or 15, so that the voltage dropped at this resistance can be evaluated a s a parameter for the corresponding lamp current $i_{L1}$ or $i_{L2}$. Further, the lamp voltage $U_{L1,2}$ valid for the two gas discharge lamps 10 and 15 is detected and evaluated.

In order to be able to monitor the heating current and the heating voltage of the two gas discharge lamps 10 and 15 there is in each case connected in series with the primary winding 7A or 11A of the corresponding heating transformer of the gas discharge lamp 10 or 15, a resistance 8 or 13, so that the voltage dropped at these resistances can in each case be evaluated as a measure for the corresponding heating current $i_{1H}$ and $i_{H2}$.

A monitoring of the mains voltage $U_N$ or the rectified intermediate circuit voltage $U_G$ delivered by the rectifier 1 is also desirable, since for example the frequency of the inverter 2 can be set to the value of an idling frequency if the voltages $U_N$ or $U_G$ do not attain a minimum voltage value necessary for the ignition or starting of the gas discharge lamps 10 and 15. In this manner the gas discharge lamps 10 and 15 can be conserved.

By means of determination of the phase difference between the lamp voltage $U_{L1,2}$ and the corresponding lamp currents $i_{L1}$ and $i_{L2}$, the control device can determine whether the load circuit with the gas discharge lamps 10 and 15 connected to the inverter 2 is acting as a capacitive load. This case can in particular appear when instead of the heating transformers 7A–C and 11A–C shown in FIG. 1 respective heating capacitors are connected parallel to the lamp coils of the gas discharge lamps 10 and 15 and the inverter 2 is operated with a low output frequency. Such a capacitive loading of the inverter 2 can in some cases lead to a destruction of the switches, constituted as field effect transistors, of the inverter 2. The internal operating state information delivered to the control device 3 also includes fault information, i.e. information on the presence or non-presence of a fault in the electronic ballast. Thus, by means of detection and monitoring of the lamp voltage $U_{L1,2}$ there can be detected and possibly corrected an excessive lamp voltage and, by means of monitoring of the lamp currents $i_{L1}$ and $i^{L2}$, an excessive lamp current. Further, by means of monitoring of the lamp voltage $U_{L1,2}$ the ignition or non-ignition of the gas discharge lamps 10 and 15 can be monitored. Finally, with the control device 3, there can also be monitored the so-called "rectifier effect" which appears in particular in the case of aged gas discharge lamps. This rectifier effect arises due to an uneven wear i.e. erosion of the lamp electrodes in the course of time, so that due to the uneven emission surfaces of the two lamp electrodes the lamp current flowing over the gas discharge path of the gas discharge lamp concerned is higher in one direction than in the other, i.e. the positive half-waves of the lamp current exceed the negative half-waves or vice versa. In the extreme case, the positive or negative half-waves disappear completely, so that the gas discharge lamp concerned operates as a rectifier. The asymmetries of the lamp current arising due to the rectifier effect are directly transferred to the heating current flowing through the primary winding of the corresponding heating transformer. Thus, the rectifier effect can be advantageously monitored by means of monitoring of this current flowing through the primary winding 7A or 11A. Thus, the heating current is branched off via resistances 16 and 17 after the corresponding primary winding 7A and 11A and delivered to the control device 3.

In accordance with the invention it is proposed to divide the control device 3 into two control units 3*a* and 3*b*, The first control unit 3*a* is, in accordance with the present invention, controlled purely in software terms and is present in particular in the form of a programmed or programmable microcontroller, i.e. microprocessor. The second control unit 3*b* is realised in purely hardware terms, i.e. includes combinations of predetermined standard circuits, and is in particular configured as an application specific integrated circuit (ASIC). An ASIC is an integrated circuit which is conceived and developed for a particular application but which is employed in large quantities in appropriate apparatuses, for example electronic ballasts. The two control units 3*a* and 3*b* are connected with one another via in particular serial interfaces by means of a bi-directional transfer line 19. A parallel interface is likewise conceivable, whereby this configuration is in particular of advantage when the control units 3*a* and 3*b* are integrated in one chip.

Figure 1:
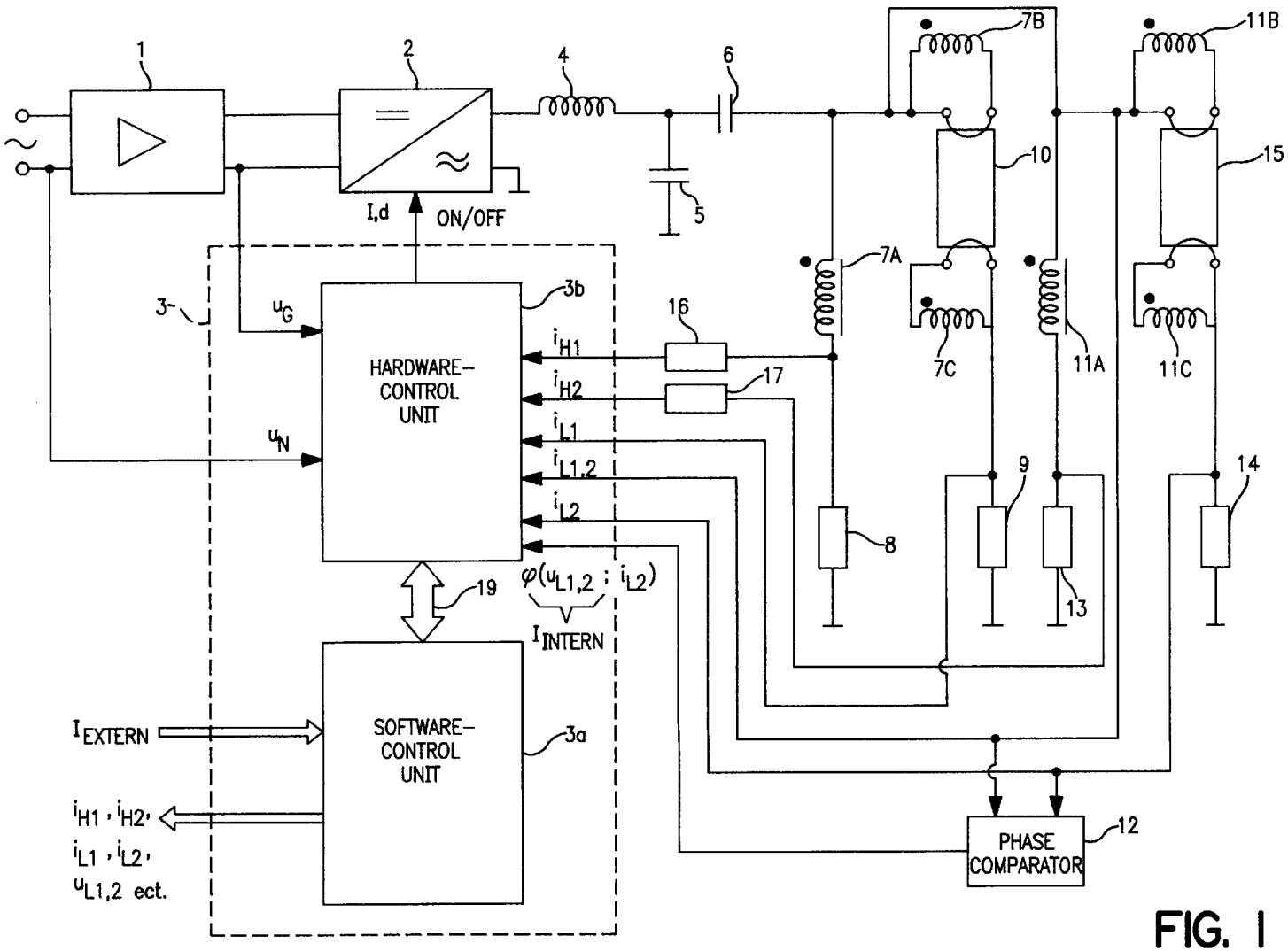
FIG. 1 shows a preferred exemplary embodiment of the control circuit in accordance with the invention, which is employed in an electronic ballast for the operation of two gas discharge lamps.

The division of the control device 3 in accordance with the invention into the control unit 3*a* controlled purely in software terms and the control unit 3*b* provided in purely hardware terms has the aim that the internal operating state information of the electronic ballast shown in FIG. 1 is delivered exclusively to the second control unit 3*b* realised in hardware terms. External control information $I_{extern}$, in contrast, is delivered exclusively to the software control unit 3*a*. This external control information may be for example desired-value inputs for particular regulation or control parameters of the electronic ballast which are transferred from a central station via a bus line or a serial interface to the software control unit 3*a*. Thus, for example, a light sensor may be connected with the software control unit 3*a* which detects the exterior illumination or interior illumination of a room, in which the at least one gas discharge lamp 10 and 15 is arranged. This sensor sends to the software control unit 3*a*, in dependence upon the detected strength of illumination, corresponding dimming information in order to bring about a dimming of the gas discharge lamps 10 and 15 appropriate to the illumination.

The control unit 3*a* controlled by software interrogates the control unit 3*b* realised in hardware via the bi-directional data transfer line 19 and receives from the control unit 3*b* the internal operating state information there applying and stored in the memory means 18. The memory means 18 are advantageously provided as write-read memory (RAM), so that information can be read out of this memory and written into the memory as desired. The internal operating state information transferred from the hardware control unit 3*b* to the software control unit 3*a* includes—as already mentioned—also information concerning faults possibly present in the electronic ballast, such as for example the appearance of a rectifier effect, a gas defect, a coil breakage or a non-ignition of the gas discharge lamps 10 and 15. Whilst, in accordance with FIG. 1, the memory means 18 are part of the hardware control unit 3*b*, the memory means 18 can of course be configured also outside the hardware control unit 3*b* (or even in the software control unit 3*a*).

The control unit 3*a* is controlled purely in terms of software, i.e. processes the information applied thereto in accordance with a predetermined and alterable program, which in particular by a simple and rapid manner and means can be adapted to circuitry engineering alterations of the electronic ballast etc. On the basis of the external control information applied to the control unit 3*a* and the internal operating state information transferred from the control unit 3*b*, the control unit 3*a* determines the actual operating control information for the electronic ballast in correspondence to the stored software program. This operational control information may for example relate to the ignition voltage, the pre-heating voltage, the pre-heating time, the ignition repetition time or other regulation values of the gas discharge lamps 10 and 15.

After determination of the operational control information, the software control unit 3*a* transfers this information via the bi-directional data transfer line 19 to the control unit 3*b*, where the operational control information is stored in the memory 18 with the internal operating state information applied to the control unit 3*b*. The control unit 3*b* realised in hardware now generates, in dependence upon the operational control information transferred from the software control unit 3*a*, the corresponding control signals for the operation of the electronic ballast or the gas discharge lamps 10 and 15, which control signals can bring about for example the switching on or off of the inverter 2 or an alteration of the frequency f or the duty ratio d of the a.c. voltage delivered from the inverter 2. The control unit 3*b* thus converts the (digital) operational information of the control unit 3*a* into (analog) control signals. Of course, however, it can also be provided that the control unit 3*b* realised purely in terms of hardware, for example constituted as an ASIC, may generate control signals for other operational parameters of the circuit shown in FIG. 1.

Advantageously, the control unit 3*a* controlled by software has an interface via which the information available in the control 3*a* can be externally interrogated or delivered. Since the internal operating state information, initially exclusively applied to the control unit 3*b*, is transferred via the bi-directional bus line 19 to the control unit 3*a*, there can thus be interrogated via this interface, and externally monitored, also the internal operating state information such as for example the heating currents, the lamp voltage or the lamp currents.

In memory means 18 there can be stored in general any desired operational information concerning the operation of the gas discharge lamps 10, 15 and in particular the internal operating state information detected by the control unit 3*b*. In particular the following information can be stored: nature of a fault which may appear, operating time counter, power counter, number of starts counter etc. This information can thus be externally interrogated and evaluated (printed out) via suitable lighting control equipment, such as e.g. the system LUXMATE of the present applicant, likewise via the interface, in order for example to obtain information concerning defective lamps or concerning the cost effectiveness and the operating times of the lamps 10, 15.

By means of the division in accordance with the invention of the control device 3 into a control unit 3*a* controlled purely in terms of software and a control unit 3*b* realised in terms of hardware it is ensured that for example the software control unit 3*a* constituted for example as a microcontroller deals with the slow control procedures and the hardware control unit 3*b*, realised for example as an ASIC, deals with the rapid control procedures, so that the advantage of the great flexibility of the software control unit 3*a* is realised without the control speed of the overall control device 3 being adversely affected.

On the other hand, the control unit 3 has the advantage of the great speed of the hardware control unit 3*b*, without the inadequate flexibility of the control unit 3*b* having effect.

What is claimed is:

1. Electronic ballast for the operation of at least one gas discharge lamp, said ballast comprising:

a control device for generating operating control signals, said control device including:

a first control unit which is constructed to be controlled solely by software, for slow control procedures; and a second control unit which is constructed to be controlled solely by hardware, for rapid control procedures, said first and second control units being connected in series, said first control unit, which is controlled exclusively by software, being connected to receives, exclusively, externally supplied control information, said second control unit, which is controlled solely by hardware, being connected to receive, exclusively, internally supplied operating state information, said first control unit being constructed to generate, in response to externally supplied control information, operational control information, and to supply said operational control information to said second control unit, said second control unit being constructed to generate, in response to received internal operating state information, and in response to said operational control information from the first control unit, control signals for the operation of the ballast, and the second control unit including a write-read memory for storing the operational control information transferred from the first control unit and for storing said received internal operating state information.

2. Electronic ballast according to claim 1, wherein:

the first and the second control units are connected to each other by means of a bi-directional data transfer line, and have a serial or parallel interface for bi-directional data transfer over said data transfer line.

3. Electronic ballast according to claim 1, wherein:

the second control unit is constructed and arranged to transfer to the first control unit, the internal operating state information which it has received, and wherein the first,control unit, on the basis of the external control information and on the basis of the internal operating state information which it receives from the second control unit, generates and transfers to the second control unit operational control information for the generation of control signals for the operation of a load.

4. Electronic ballast according to claim 3, wherein the first control unit includes an interface through which external control information and/or internal operating state information received by the second control unit can be called up.

5. Electronic ballast according to claim 1, wherein:

the first control unit is connected to receive external control information via an interface or a data bus.

6. Electronic ballast according to claim 1, wherein:

said external control information includes control information received from external sensor devices.

7. Electronic ballast according to claim 1, wherein:

the first control unit comprises a programable microcontroller.

8. Electronic ballast according to claim 1, wherein:

the second control unit comprises an application specific integrated circuit (ASIC).

9. Electronic ballast according to claim 1, further including:

an inverter which is arranged to be supplied with a d.c. voltage and which generates a clocked a.c. voltage;

a series resonance circuit connected to said inverter;

and a gas discharge lamp connected to the series resonance circuit.

10. Electronic ballast according to claim 9, wherein:

means are provided such that control signals generated by the second control unit are used for controlling the frequency and/or the duty ratio of the clocked a.c. voltage supplied by the inverter.

11. Electronic ballast according to claim 9, wherein:

the control signals generated by said second control unit correspond to the pre-heating voltage, the ignition voltage, the pre-heating time or the ignition repetition time of the at least one gas discharge lamp.

12. Electronic ballast according to claim 9, wherein:

said internal operating state information includes lamp voltage, lamp current, heating current, phase angle between the lamp voltage and the lamp current of the at least one gas discharge lamp, a d.c. voltage supplied to the inverter, or a supply a.c. voltage applied to the rectifier for the generation of a d.c. voltage.

13. Electronic ballast according to claim 9, wherein:

the internal operating state information includes fault information corresponding to fault states in the electronic ballast.

14. Electronic ballast according to claim 13, wherein:

said fault information corresponds to the presence of a rectifier effect, an excessive lamp voltage, an excessive lamp current, a coil break, a gas defect, or a non-ignition condition of the at least one gas discharge lamp, or the presence of a capacitive loading of the inverter.

15. Electronic ballast according to claim 9, wherein:

the external control information which is supplied to the first control unit includes desired-value information for particular control parameters of the electronic ballast.

16. Electronic ballast according to claim 9, wherein:

the external control information which is supplied to the first control unit includes actual values of particular environmental parameters.

17. Electronic ballast according to claim 16, wherein:

said environmental parameters correspond to the exterior illumination of a room in which the at least one gas discharge lamp is arranged, and/or the interior illumination of the room.

18. Electronic ballast according to claim 9, further including:

an electronic harmonics filter arranged to deliver a d.c. voltage to the inverter, said control device being arranged to generate a control signal for the electronic harmonics filter.

* * * * *